US009943887B2

(12) United States Patent
Seo et al.

(10) Patent No.: US 9,943,887 B2
(45) Date of Patent: Apr. 17, 2018

(54) FLUID SUPPLYING APPARATUS AND SYSTEM AND METHOD FOR CLEANING THIN FILM USING THE SAME

(71) Applicant: LG CHEM, LTD., Seoul (KR)

(72) Inventors: Young Ju Seo, Daejeon (KR); Chae-Ho Chung, Daejeon (KR); Do-Ki Chang, Chungbuk (KR); Ki-Kyo Yeom, Chungbuk (KR); Ye-Hoon Im, Daejeon (KR); Jae-Min Kim, Chungbuk (KR); Kyoung-Hoon Min, Daejeon (KR); Won-Chan Park, Daejeon (KR)

(73) Assignee: LG CHEM, LTD., Seoul (KR)

( * ) Notice: Subject to any disclaimer, the term of this patent is extended or adjusted under 35 U.S.C. 154(b) by 1280 days.

(21) Appl. No.: 13/768,996

(22) Filed: Feb. 15, 2013

(65) Prior Publication Data

US 2013/0174878 A1 Jul. 11, 2013

Related U.S. Application Data

(63) Continuation of application No. PCT/KR2011/006044, filed on Aug. 17, 2011.

(30) Foreign Application Priority Data

Aug. 19, 2010 (KR) ..... 10-2010-0080446

(51) Int. Cl.

| | |
|---|---|
| ***B08B 3/04*** | (2006.01) |
| ***B08B 3/02*** | (2006.01) |
| ***B08B 3/10*** | (2006.01) |

(52) U.S. Cl.

CPC ..... *B08B 3/04* (2013.01); *B08B 3/022* (2013.01); *B08B 3/041* (2013.01); *B08B 3/10* (2013.01)

(58) Field of Classification Search

CPC ..... A47L 15/23; A47L 15/4282; A47L 15/22; A47L 15/4221; A47L 15/16

(Continued)

(56) References Cited

U.S. PATENT DOCUMENTS 3,051,183 A * 8/1962 Jacobs ..... A47L 15/23 134/107
5,029,598 A 7/1991 Stroszynski et al.

(Continued)

FOREIGN PATENT DOCUMENTS

| | | | | |
|---|---|---|---|---|
| CN | 1118717 A | | 3/1996 | |
| CN | 1334418 A | | 2/2002 | |
| GB | 2199734 A | * | 7/1988 | ..... A47L 15/4282 |
| JP | H5-2752 | | 1/1993 | |
| JP | 07-297162 | | 11/1995 | |
| JP | 2000-144594 | | 5/2000 | |
| JP | 2002-011516 | | 1/2002 | |
| JP | 2002-028537 | | 1/2002 | |
| JP | 2002-373876 A | | 12/2002 | |
| JP | 2005-336582 | | 12/2005 | |

(Continued)

OTHER PUBLICATIONS

Masayoshi, "Etching Apparatus and Method for Manufacturing Circuit Board" Dec. 2005, JP 2005-336582 (Machine Translation).*

(Continued)

*Primary Examiner* — David G Cormier
*Assistant Examiner* — Thomas Bucci
(74) *Attorney, Agent, or Firm* — Dentons US LLP

(57) ABSTRACT

A fluid supplying apparatus includes an inner tube having a plurality of holes for distributing a fluid supplied from a supply unit, and an outer tube arranged coaxially or non-coaxially with the inner tube to surround the inner tube and having a plurality of slots for injecting the fluid distributed therein from the holes to the outside. The outer tube substantially has the same length as the inner tube. The fluid supplying apparatus may be used for a thin film cleaning system or method.

5 Claims, 7 Drawing Sheets

(58) Field of Classification Search
USPC ..... 134/198, 56 D, 176, 179, 172, 178, 180, 134/95.3, 103.2, 148, 98.1; 239/251, 227, 239/245, 214, 222.17, 242; 222/630, 401, 222/380, 385, 402.1
See application file for complete search history.

(56) References Cited

U.S. PATENT DOCUMENTS

| | | | | |
|---|---|---|---|---|
| 5,540,247 | A * | 7/1996 | Kawatani | B08B 3/102 134/182 |
| 2002/0011273 | A1 | 1/2002 | Miyamoto | |
| 2007/0289615 | A1* | 12/2007 | Shin | A47L 15/23 134/56 D |
| 2009/0260979 | A1* | 10/2009 | Saitou | C25D 17/00 204/212 |

FOREIGN PATENT DOCUMENTS

| | | | |
|---|---|---|---|
| JP | 2005336582 | A * | 12/2005 |
| JP | 2006-198581 | | 8/2006 |
| JP | 2006198581 | A * | 8/2006 |
| JP | 2007-270321 | | 10/2007 |
| JP | 2008-095160 | | 4/2008 |
| KR | 10-0135073 | | 4/1998 |
| KR | 10-2010-0058999 | | 6/2010 |

OTHER PUBLICATIONS

Kiyoshi et al., "Storage Position Detecting Device" Aug. 2006, JP 2006-198581 (Machine Translation).*

* cited by examiner

Prior Art

FLUID SUPPLYING APPARATUS AND SYSTEM AND METHOD FOR CLEANING THIN FILM USING THE SAME

CROSS-REFERENCE TO RELATED APPLICATION

This application is a continuation of International Application No. PCT/KR2011/006044 filed on Aug. 17, 2011, which claims priority to Korean Patent Application No. 10-2010-0080446 filed in the Republic of Korea on Aug. 19, 2010, the entire contents of which are incorporated herein by reference.

TECHNICAL FIELD

The present disclosure relates to a fluid supplying apparatus and a system and method for cleaning a thin film using the same. More particularly, the present disclosure relates to a fluid supplying apparatus with an improved structure for uniformly and stably supplying a cleaning fluid to clean a film (for example, film-roll) type plate in a bath storing a fluid, and a system and method for cleaning a thin film using the same.

BACKGROUND ART

For example, systems for producing a film or roll type plate (hereinafter, referred to as a "thin film") having a film-type sheet with several micrometers or several ten micrometers, e.g., flooring films or various functional films, perform a cleaning process for removing impurities adhered to the surface of the roll-type thin film. In this film cleaning process, a cleaning fluid (e.g., liquid) is injected to the surface of the thin film to remove the impurities adhered to the surface of the thin film.

FIG. 1 is a schematic view showing a conventional thin film cleaning system. FIG. 2 is a graph showing a flow rate of a fluid corresponding to each hole of a nozzle tube in the system of FIG. 1.

Referring to FIGS. 1 and 2, the conventional thin film cleaning system 1 includes a fluid supplying apparatus 5 disposed in a cleaning bath 2 to be immersed in an immersion liquid 3 and capable of injecting a cleaning fluid so that impurities present in the surface (the upper and/or lower surface) of a thin film 4 which is successively moved while being immersed in the immersion liquid 3 stored in the cleaning bath 2.

The conventional fluid supplying apparatus 5 includes a supply tube 6 installed in the cleaning bath 2 to receive a cleaning fluid from the outside, and a nozzle tube 7 diverged vertically from the supply tube 6 to uniformly inject the cleaning fluid toward the thin film 4 with a predetermined pressure. The nozzle tube 7 is hollow with closed ends on both sides and has a plurality of holes 8 in a length direction. The thin film 4 is rolled on a plurality of rollers 9 and moves at a predetermined speed. The cleaning fluid injected from the holes 8 gives a predetermined pressure to the surface of the thin film 4 moving in association with the immersion liquid 3. This pressure is at the level allowing impurities present on the surface of the thin film 4 to be removed. In other words, the holes 8 formed in the nozzle tube 7 have a kind of nozzle function. Though FIG. 1 shows that the fluid supplying apparatus 5 is disposed above the thin film, the nozzle tube 7 may also be located only below the thin film 4 or both above and below the thin film 4.

However, in the conventional thin film cleaning system 1, since the diameter of the holes 8 for injecting a cleaning fluid is smaller than the diameter of the nozzle tube 7, the cleaning fluid supplied into the nozzle tube 7 from the supply tube 6 flows faster while passing through the holes 8. The increased flow rate of the cleaning fluid collides with the wall of the cleaning bath 2 and returns, and in this process, the flowing pattern of the fluid in the cleaning bath 2 gets complicated. Such a complicated flow pattern applies irregular pressure to the thin film 4 moving above or below the nozzle tube 7. If the pressure deviation increases, for example, the thin film 4 may fold or droop. This phenomenon, namely the fact that the thin film 4 progresses to the next process over the roller 9 in a state of being folded, may give a serious influence when the thin film 4 fractures.

DISCLOSURE

Technical Problem

The present disclosure is designed to solve the problems of the prior art, and therefore it is an object of the present disclosure to provide a fluid supply apparatus with an improved structure which may decrease the deviation of pressure applied to a thin film by reducing or controlling a flux or flow rate of a fluid finally injected, since a single tube structure of a conventional fluid supply apparatus which just strongly injects a fluid in a roll-type thin film cleaning process is changed to a double tube structure.

Another object of the present disclosure is to provide a thin film cleaning system and method using the fluid supplying apparatus.

Technical Solution

In one aspect, there is provided a fluid supplying apparatus, which includes: an inner tube having a plurality of holes for distributing a fluid supplied from a supply unit; and an outer tube arranged to surround the inner tube and having a plurality of slots for injecting the fluid distributed therein from the holes to the outside.

Preferably, both ends of the inner tube and the outer tube are closed, the inner tube and the outer tube are coaxially arranged, and the inner tube and the outer tube substantially have the same length. In another embodiment, the inner tube and the outer tube may be arranged non-coaxially.

In other words, the fluid supplying apparatus according to an embodiment includes the inner tube in which a plurality of holes are arranged in a row and the outer tube installed to surround the inner tube and having a plurality of slots arranged therein. Here, the gap between the holes formed in the inner tube and the gap between the slots formed in the outer tube may be suitably adjusted, as apparent to those having ordinary skill in the art.

If the fluid supplying apparatus of this embodiment is used, the fluid supplied from the supply unit and collected in the inner tube is primarily supplied into the outer tube through the holes while controlling its flux and flow rate, and the fluid collected in the outer tube is discharged out of the outer tube through the slots formed in the outer tube so that a flow rate and flux of the fluid finally injected may be suitably adjusted.

In the fluid supplying apparatus according to a preferred embodiment of the present disclosure, the slots may include first side slots arranged in any one side of the outer tube in a length direction; and second side slots arranged in the other side of the outer tube to be opposite to the first side slots.

Preferably, the first side slots are arranged in a row at regular intervals in a length direction of the outer tube, and the second side slots are formed symmetrically based on the center of the outer tube.

In the fluid supplying apparatus according to a preferred embodiment of the present disclosure, the arrangement of the holes formed in the inner tube is substantially orthogonal to the arrangement of the slots. Therefore, when the first side slots and the second side slots are located through both sides of the cross-section of the outer tube, the holes formed in the inner tube are preferably disposed through the upper or lower surface of the inner tube. In particular, in an embodiment, the holes of the inner tube are arranged in a line pattern in the upper surface thereof.

In the fluid supplying apparatus according to a preferred embodiment of the present disclosure, the inner tube and the outer tube have cross-sections with substantially any one shape selected from the group consisting of circle, oval, rectangle and hexagon, or their combinations. In other words, the inner tube and the outer tube may have the same cross-sectional shape, but for example, when the inner tube has a circular cross-section, the outer tube may have an oval cross-section or one of various polygonal cross-sections, or vice versa. Here, the circular cross-section may decrease a friction of the fluid.

In the fluid supplying apparatus according to a preferred embodiment of the present disclosure, the holes include first side holes arranged in any one side of the inner tube in a length direction; and second side holes arranged in the other side of the inner tube to be opposite to the first side holes. In other words, according to an alternative embodiment, two rows of holes may be formed in the inner tube, different from the previous embodiments.

In the fluid supplying apparatus according to a preferred embodiment of the present disclosure, when the inner tube and the outer tube have circular or oval cross-sections, the difference between the diameters of the outer tube and the inner tube (e.g., the distance between the outer circumstance of the inner tube and the inner circumference of the outer tube) or the difference in widths and heights between the outer tube and the inner tube is about 25 mm to 35 mm. Here, the difference in widths means the difference between the distance between the vertical outer walls of the inner tube and the distance between the vertical inner walls of the outer tube, and the difference in heights means the difference between the distance between the horizontal outer walls of the inner tubes and the distance between the horizontal inner walls of the outer tubes. If the gap (e.g., diameter, width or height) between the inner tube and the outer tube is smaller than 25 mm, the flow rate of the fluid may not decrease since the gap from the inner tube to the outer tube is small. If the gap between the inner tube and the outer tube is greater than 35 mm, the size of the device is unnecessarily increased, and the flow rate in the outer tube is relatively decreased and therefore the flow rate of the fluid finally injected is decreased, thereby not giving a sufficient effect. Preferably, the gap between the outer tube and the inner tube is about 30 mm.

In the fluid supplying apparatus according to a preferred embodiment of the present disclosure, each of the holes has a diameter of about 10 mm, and each of the slots has a length of about 240 mm. If the diameter of the hole is too great, the flow rate of the fluid injected into the outer tube is decreased, and a consistent flow pattern may not be easily formed. If the diameter of the hole is too small, the flow rate of the fluid supplied to the outer tube is increased, which may generate an eddy.

In the fluid supplying apparatus according to a preferred embodiment of the present disclosure, the width of the slots is substantially identical to the diameter of the holes.

In one embodiment where both of the inner tube and the outer tube have circular cross-sections, in the case where the inner tube has holes with a diameter of about 10 mm, the outer tube may have a diameter of about 130 mm, and each slot may have a length of about 240 mm. In addition, in another embodiment where both of the inner tube and the outer tube have oval cross-sections, in the case where the inner tube has a horizontal width of about 200 mm, a vertical height of about 100 mm, and a hole diameter of about 10 mm, the outer tube may have a width of about 230 mm, a height of about 130 mm and a slot length of about 240 mm.

In the fluid supplying apparatus according to a preferred embodiment of the present disclosure, both ends of the inner tube and the outer tube are closed, and the outer wall of the inner tube and the inner wall of the outer tube form a closed space. The side wall at one end of the supply unit communicates with the inner tube through the center of the outer tube. Therefore, the side at the end of the supply unit serves as a partition of the closed space formed by the inner tube and the outer tube.

In the fluid supplying apparatus according to a preferred embodiment of the present disclosure, the fluid may be a gas, but more preferably the fluid is a mixed solution of water and an organic solvent. In addition, the inner tube and the outer tube are preferably made of metal or plastic.

In another aspect, there is provided a thin film cleaning system, which includes a cleaning bath in which a fluid is stored so that a thin film is capable of moving while being immersed therein; and the fluid supplying apparatus described in the above embodiments, which is installed in the cleaning bath to inject the fluid toward the thin film.

The thin film cleaning system according to this embodiment is used for washing off impurities present at the surface of a roll-type thin film which has experienced chemical treatment and coating necessary for manufacturing a thin film demanded in the industry, for example a sheet with a thickness of several micrometers or several ten micrometers, a floor film or various kinds of functional films, as apparent to those having ordinary skill in the art. In the thin film cleaning system of this embodiment, the fluid used in the fluid supply apparatus is preferably replaced with a cleaning fluid (liquid). In other words, in the cleaning system of this embodiment, the immersion liquid stored in the cleaning bath is substantially identical to the cleaning fluid introduced through the double-tube type fluid supplying apparatus, and the liquid discharged through a drain hole of the cleaning bath is supplied to the double-tube type fluid supplying apparatus by a pump or the like. In addition, the locations, dimensions, sizes, arrangements, deformations or the like of the components such as the inner tube, the outer tube, the holes and the slots of the fluid supplying apparatus used in the thin film cleaning system of this embodiment are identical to those of the previous embodiments and therefore not described in detail.

In still another aspect, there is provided a thin film cleaning method, which includes (a) moving a thin film in a state of being immersed in a fluid stored in a cleaning bath; and (b) using a double-tube type fluid supplying apparatus including an inner tube with a plurality of holes and an outer tube with a plurality of slots to inject the fluid through the slots at a uniform pressure in a state of being immersed in the fluid.

In one embodiment of the present disclosure, in the step (b), the fluid is injected to opposite sides along a length direction of the outer tube.

In the thin film cleaning method according to one embodiment of the present disclosure, the double-tube type fluid supplying apparatus may be arranged substantially in parallel to the moving direction of the thin film. In other words, in the state where the double-tube type fluid supplying apparatus is disposed spaced apart from the thin film by a predetermined distance, the fluid supplying apparatus may be arranged in the cleaning bath so that the center line in the length direction of the double-tube type fluid supplying apparatus is parallel to the length or width direction of the thin film. In other words, if the center line of the double-tube type fluid supplying apparatus in the length direction is arranged in parallel to the length direction of the thin film, the fluid injected through the outer tube of the double-tube type fluid supplying apparatus is injected to both lateral sides with respect to the length direction of the thin film, while, if the center line of the double-tube type fluid supplying apparatus in the length direction is arranged in parallel to the width direction of the thin film, the fluid may be injected to both front and rear sides with respect to the moving direction of the thin film.

In one embodiment of the present disclosure, the inner tube and the outer tube of the double-tube type fluid supplying apparatus have cross-sections with any one shape selected from the group consisting of circle, oval, rectangle and hexagon, or their combinations.

Advantageous Effects

The fluid supplying apparatus and the thin film cleaning system and method according to the present disclosure give the following effects.

First, if a fluid is supplied to a desired portion by the double-tube type fluid supplying apparatus including an inner tube having a plurality of holes and an outer tube arranged at the outside of the inner tube and having a plurality of slots, the flow rate and flux of the fluid may be adjusted to a level demanded by a target to control a pressure of the fluid as necessary.

Second, since the fluid is injected through the holes (primary injection) of the inner tube and the slots (secondary injection) of the outer tube by immersing the fluid supplying apparatus in a fluid while a thin film is immersed in the fluid stored in the cleaning bath and moving, it is possible to decrease an unnecessary pressure deviation of the moving thin film, which is caused by irregular flow patterns probably generated when the injected fluid collides with the wall of the cleaning bath and returns.

Third, according to the thin film cleaning system or method, the deviation of pressure applied to the thin film may be decreased by reducing or controlling a flow rate or flux of the fluid injected through the fluid supplying apparatus, and as a result, in the thin film cleaning process, it is possible to prevent the thin film from drooping or folding by irregular pressure of the fluid, which may solve problems such as breakage or inferiority of the thin film in following processes.

DESCRIPTION OF DRAWINGS

Other objects and aspects of the present disclosure will become apparent from the following descriptions of the embodiments with reference to the accompanying drawings. The drawings illustrate a fluid supplying apparatus and a thin film cleaning system and method according to exemplary embodiments. However, it should be understood that the disclosure is not limited to components or means depicted in the drawings. In the drawings.

BEST MODE

Figure 1:
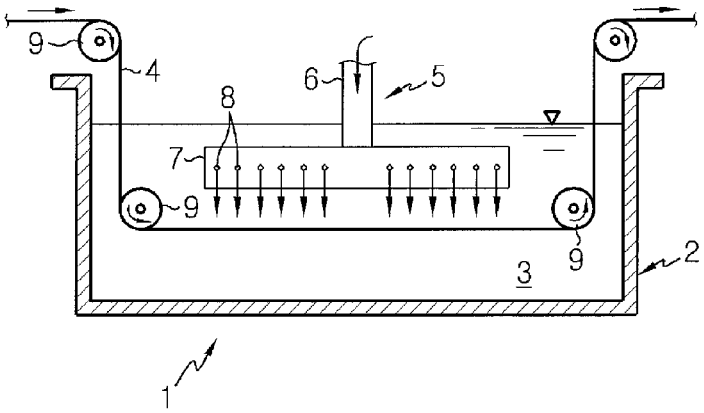
FIG. 1 is a schematic view showing a conventional thin film cleaning system.
Figure 2:
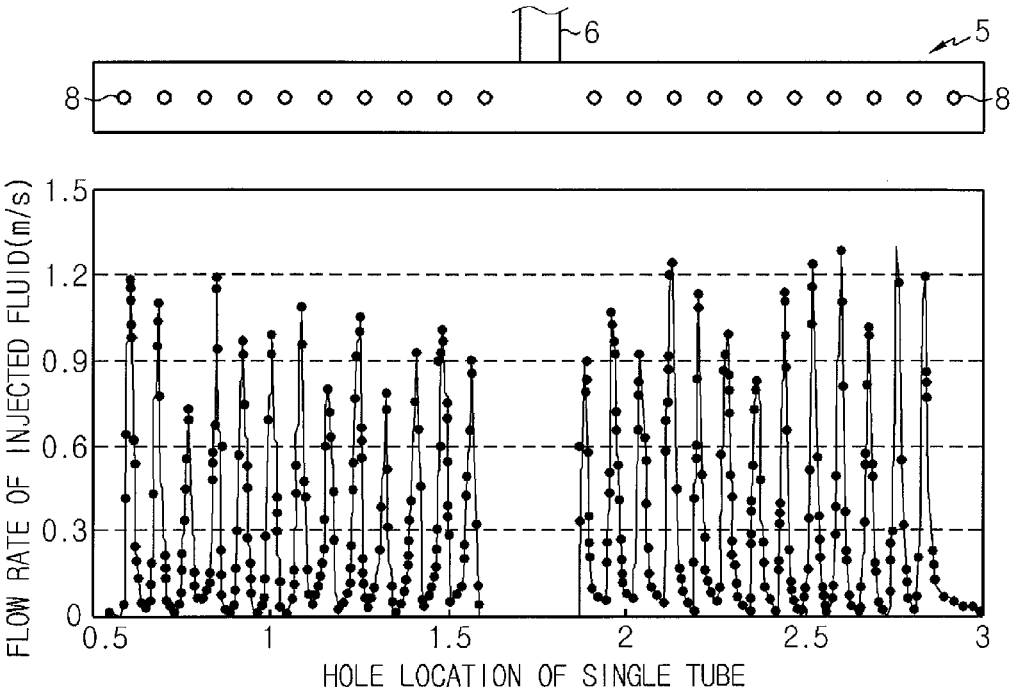
Prior Art FIG. 2
FIG. 2 is a graph showing a flow rate of a fluid corresponding to each hole in a nozzle tube employed in the thin film cleaning system of FIG. 1.

Terms used in the following detailed description are for convenience and not for limiting the disclosure. Terms such as "right", "left", "top surface", and "bottom surface" represent a respective direction in the drawing that it refers to. Terms such as "inward" and "outward" respectively represent a direction oriented to or departing from a geometric center of a respective designated apparatus, system, or member. Terms such as "front", "rear", "upper", "lower" and its relevant words or phrases represent locations and orientations in the drawing that it refers to, and they are not intended to limit the disclosure. These terms include words listed above, their derivatives and their synonyms.

Exemplary embodiments will be described with reference to the accompanying drawings.

Figure 3:
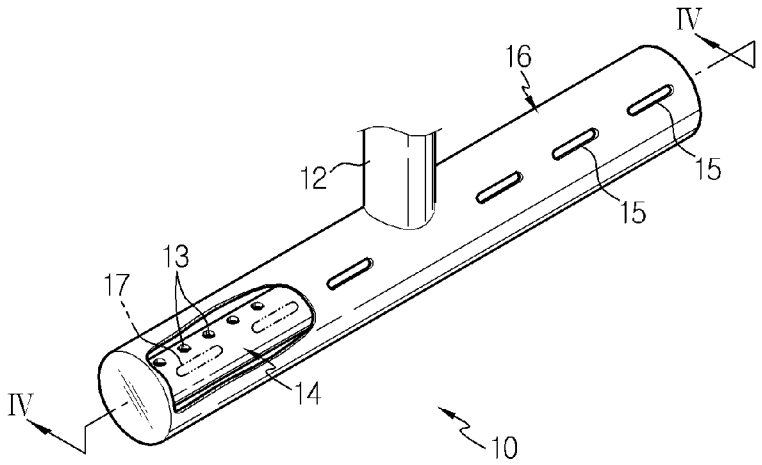
FIG. 3 is a partially sectioned perspective view schematically showing a fluid supplying apparatus according to a first embodiment of the present disclosure.
Figure 4:
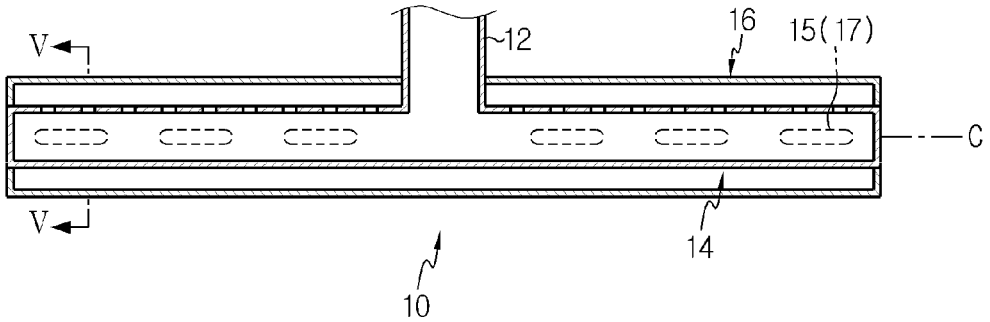
FIG. 4 is a sectional view taken along the line IV-IV of FIG. 3.
Figure 5:
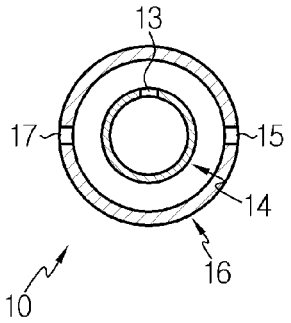
FIG. 5 is a sectional view taken along the line V-V of FIG. 4.

FIG. 3 is a partially sectioned perspective view schematically showing a fluid supplying apparatus according to a first embodiment of the present disclosure, FIG. 4 is a sectional view taken along the line IV-IV of FIG. 3, and FIG. 5 is a sectional view taken along the line V-V of FIG. 4.

Referring to FIGS. 3 to 5, the fluid supplying apparatus 10 according to the first embodiment of the present disclosure includes, for example, a supply unit 12 receiving a fluid such as liquid (e.g., a cleaning fluid) from the outside, an inner tube 14 installed to communicate with the supply unit 12 and having closed ends on both sides and a plurality of holes formed through the upper surface thereof, and an outer tube 16 disposed spaced apart from the inner tube 14 by a predetermined distance to surround the inner tube 14 and having closed ends on both sides and first and second side slots 15 and 17 with a predetermined length respectively formed in both sides thereof. Here, the cleaning fluid supplied through the supply unit 12 flows into the outer tube 16 through the plurality of holes 13 formed in the inner tube 14 and is injected through the slots 15 and 17 formed in the outer tube 16. At this time, both of the inner tube 14 and the outer tube 16 have circular cross-sections. In addition, the inner tube 14 has a diameter of about 100 mm, and each hole 13 has a diameter of about 10 mm. Moreover, the outer tube 16 has a diameter of about 130 mm, and each slot 15 and 17 has a length of about 240 mm. In other words, the difference between the diameter of the outer tube 16 and the diameter of the inner tube 14 is about 30 mm. The velocity of the flow flowing into the outer tube 16 through each hole 13 is relatively fast. In fact, a pressure is added to the fluid since the space through which the fluid flows from the inner tube 14 to the outer tube 16, namely the cross-sectional area of the hole 13, is abruptly decreasing, compared with the fluid flowing from the supply unit 12 to the inner tube 14. For this reason, the flow rate of the fluid is increased.

In addition, the first side slots 15 and the second side slots 17 respectively formed in both sides of the outer tube are located at opposite locations based on the center line C (see FIG. 4) of the outer tube 16. Each of these slots 15 and 17 is formed larger than the size of the holes 13 formed in the inner tube 14. By doing so, the flow rate of the fluid injected through the slots 15 and 17 of the outer tube 16 may be decreased. In other words, the difference in flow rates which may occur when the fluid is injected through the slots 15 and 17, namely flux deviation, may be overcome by uniformly maintaining the amount of fluid primarily injected from the holes 13 formed in the inner tube 14 into the outer tube 16. Therefore, the difference in flow rates of the fluid passing through the slots 15 and 17, namely the flux deviation, may be relatively reduced.

Meanwhile, though this embodiment has been illustrated in that the plurality holes 13 are formed through the inner tube 14, the holes 13 may be formed in the lower surface of the inner tube 14 or any one of both sides thereof. In addition, though the holes 13 of this embodiment are arranged substantially in a row in the upper surface of the inner tube 14, the holes 13 may be arranged not in a row but formed in a random pattern through the inner tube 14, as apparent to those of ordinary skill in the art. In addition, the length and diameter of the inner tube 14 and the outer tube 16, the diameter of the holes 13 formed in the inner tube 14, and the length of the slots 15 and 17 formed in the outer tube 16 may be variously changed according to requirements demanded by the fluid supplying apparatus 10 or flow rate, properties or the like of the fluid supplied through the supply unit 12, as apparent to those of ordinary skill in the art.

Figure 6:
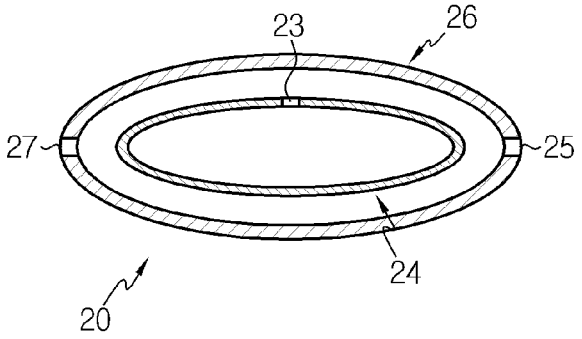
FIG. 6 is a sectional view showing a fluid supplying apparatus according to a second embodiment of the present disclosure.

FIG. 6 is a sectional view showing a fluid supplying apparatus according to a second embodiment of the present disclosure.

Referring to FIG. 6, the fluid supplying apparatus 20 of this embodiment is identical to that of the first embodiment, except that both of the inner tube 24 and the outer tube 26 have oval cross-sections. Here, the inner tube 24 has a width of about 200 mm in a horizontal direction and a height of about 100 mm in a vertical direction, and each hole 23 formed in the inner tube 24 has a diameter of about 10 mm. The outer tube 26 disposed to surround the inner tube 24 has a width of about 230 mm and a height of about 130 mm, and each slot 25 and 27 formed in the outer tube 26 has a length of about 240 mm. In other words, the difference in widths and heights between the outer tube 26 and the inner tube 24 is about 30 mm.

According to this embodiment, the distance by which the fluid passing through the holes 23 of the inner tube 24 reaches the slots 25 and 27 of the outer tube 26 is longer than that of the first embodiment, and therefore the deviation of a flow rate may be reduced as much.

Hereinafter, various modified examples in which a plurality of holes are formed in a line through the upper surface of the inner tube, and first and second side slots are formed respectively in both sides (the right and left sides in the figures) of the outer tube will be described.

Figure 7:
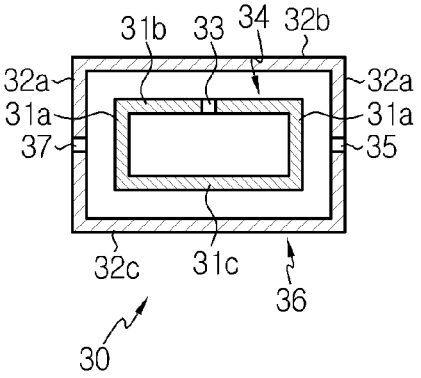
FIG. 7 is a sectional view showing a fluid supplying apparatus according to a third embodiment of the present disclosure.

FIG. 7 is a sectional view showing a fluid supplying apparatus according to a third embodiment of the present disclosure;

Referring to FIG. 7, in the fluid supplying apparatus 30 of this embodiment, both of the inner tube 34 and the outer tube 36 substantially have rectangular cross-sections. The inner tube 34 according to this embodiment includes two inner side walls 31*a* parallel to each other and an inner upper wall 31*b* and an inner lower wall 31*c* which connect the inner side walls 31*a*. The holes 33 for primary injection of a fluid are formed through an approximately central point of the inner upper wall 31*b*. In addition, the outer tube 36 of this embodiment has two outer side walls 32*a* parallel to each other and an outer upper wall 32*b* and an outer lower wall 32*c* which connect the outer side walls 32*a*. The slots 35 and 37 for final injection of the fluid are respectively formed through an approximately central point of the outer side walls 32*a*.

Figure 8:
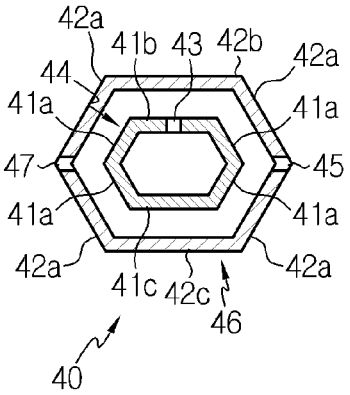
FIG. 8 is a sectional view showing a fluid supplying apparatus according to a fourth embodiment of the present disclosure.

FIG. 8 is a sectional view showing a fluid supplying apparatus according to a fourth embodiment of the present disclosure;

Referring to FIG. 8, in the fluid supplying apparatus 40 of this embodiment, both of the inner tube 44 and the outer tube 46 have substantially hexagonal cross-sections. The inner tube 44 of this embodiment includes four inclined inner side walls 41*a*, and an inner upper wall 41*b* and an inner lower wall 41*c* which connect the right and left inner side walls 41*a*. The holes 43 for primary injection of a fluid are formed through an approximately central point of the inner upper wall 41*b*. In addition, the outer tube 46 of this embodiment includes four outer side walls 42*a*, and an outer upper wall 42*b* and an outer lower wall 42*c* which connect the right and left outer side walls 42*a*. The slots 45 and 47 for final injection of the fluid are formed through contact portions (right and left edge portions) of the inclined outer side walls 42*a*.

Though the inner tube and the outer tube have the same cross-sectional shape in the embodiments shown in FIGS. 5 to 8, the fluid supply apparatus may be configured so that the inner and outer tubes have various cross-sectional shapes such as a pentagon, a heptagon and an octagon as alternative embodiments, as apparent to those having ordinary skill in the art.

Figure 9:
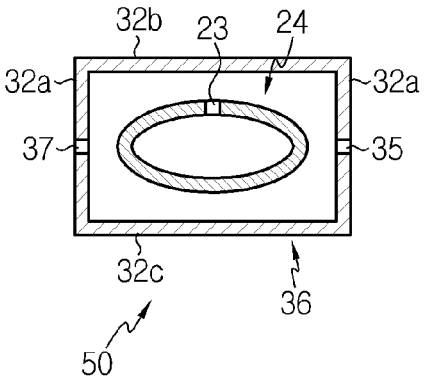
FIG. 9 is a sectional view showing a fluid supplying apparatus according to a fifth embodiment of the present disclosure.

FIG. 9 is a sectional view showing a fluid supplying apparatus according to a fifth embodiment of the present disclosure. The component having the same reference symbol as in FIGS. 6 and 7 represents the same component with the same function.

Referring to FIG. 9, in the fluid supplying apparatus 50 of this embodiment, the inner tube 24 has an oval cross-section, and the outer tube 36 has a substantially rectangular cross-section. The inner tube 24 of this embodiment is a tube member with an oval cross-section, and the holes 23 for primary injection of a fluid are formed in the upper surface of the tube member. In addition, the outer tube 36 of this embodiment includes two outer side walls 32*a* parallel to each other, and an outer upper wall 32*b* and an outer lower wall 32*c* which connects the outer side walls 32*a*. The slots 35 and 37 for final injection of the fluid are respectively formed through an approximately central point of the outer side walls 32*a*. In this embodiment, the interval between the inner tubes 24 having the holes and the outer tube 36 having the slots 35 and 37 is substantially identical as a whole, but the interval between the inner tube 24 and the outer tube 36 is relatively greater at four edge portions of the outer tube 36.

Figure 10:
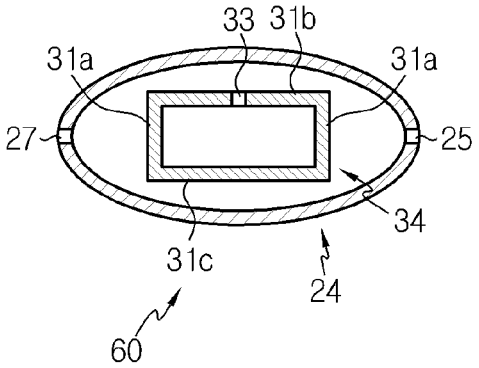
FIG. 10 is a sectional view showing a fluid supplying apparatus according to a sixth embodiment of the present disclosure.

FIG. 10 is a sectional view showing a fluid supplying apparatus according to a sixth embodiment of the present disclosure. The component having the same reference symbol as in FIGS. 6 and 7 represents the same component with the same function.

Referring to FIG. 10, in the fluid supplying apparatus 60 of this embodiment, the inner tube 34 has a substantially rectangular cross-section, and the outer tube 26 has an oval cross-section. The inner tube 34 of this embodiment includes two inner side walls 31*a* parallel to each other, and an inner upper wall 31*b* and an inner lower wall 31*c* which connects the inner side walls 31*a*. The holes 33 for primary injection of a fluid are formed through an approximately central point of the inner upper wall 31*b*. In addition, the outer tube 26 of this embodiment is a tube member with an oval cross-section, and the slots 25 and 27 for final injection of the fluid are formed through both sides of the tube member.

Though the inner and outer tubes have an oval or rectangular cross-sectional shape in the embodiments shown in FIGS. 9 and 10, the rectangular cross-section may be replaced with a square cross-section. In addition, an inner tube with various cross-sectional shapes such as circle and hexagon may be provided to an outer tube with a rectangular cross-section, and an inner tube with various cross-sectional shapes such as circle and hexagon may be provided to an outer tube with an oval cross-section, as apparent to those having ordinary skill in the art.

Though the holes are formed through the upper wall of the inner tube in the embodiments shown in FIGS. 5 to 10, the holes may be formed through the lower wall of the inner tube, as apparent to those having ordinary skill in the art.

Figure 11:
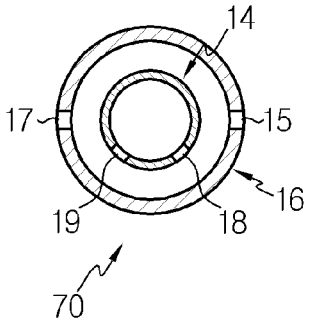
FIG. 11 is a sectional view showing a fluid supplying apparatus according to a seventh embodiment of the present disclosure.

FIG. 11 is a sectional view showing a fluid supplying apparatus according to a seventh embodiment of the present disclosure. The component having the same reference symbol as in FIG. 5 represents the same component with the same function.

Referring to FIG. 11, in the fluid supplying apparatus 70, the inner tube 14 and the outer tube 16 have circular cross-sections, identical to the first embodiment, but a first hole unit 18 and a second hole unit 19 are formed symmetrically in the lower wall of the inner tube 14. Here, the holes of the first hole unit 18 and the second hole unit 19 are arranged in parallel to each other. Even in the first embodiment, two rows of slots may be formed in the upper surface of the inner tube 14, as apparent to those having ordinary skill in the art.

Figure 12:
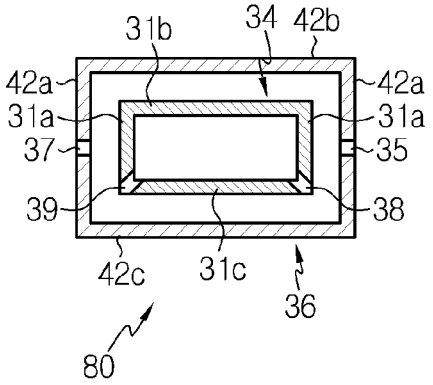
FIG. 12 is a sectional view showing a fluid supplying apparatus according to an eighth embodiment of the present disclosure.

FIG. 12 is a sectional view showing a fluid supplying apparatus according to an eighth embodiment of the present disclosure. The component having the same reference symbol as in FIG. 7 represents the same component with the same function.

Referring to FIG. 12, in the fluid supplying apparatus 80 of this embodiment, the inner tube 14 and the outer tube 16 have substantially rectangular cross-sections, identical to the third embodiment, but two rows of holes 38 and 39 are formed in parallel with each other in the lower side of the inner tube 34, different from the third embodiment. In other words, the inner tube 34 of this embodiment includes two inner side walls 31*a* parallel to each other, and an inner upper wall 31*b* and an inner lower wall 31*c* which connect the inner side walls 31*a*. The holes 38 and 39 for primary injection of a fluid are formed through a portion where the end of the inner lower all 31*c* is connected to the inner side walls 31*a*.

Figure 13:
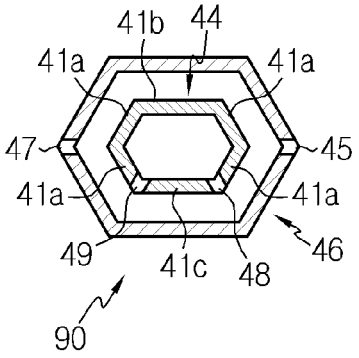
FIG. 13 is a sectional view showing a fluid supplying apparatus according to a ninth embodiment of the present disclosure.

FIG. 13 is a sectional view showing a fluid supplying apparatus according to a ninth embodiment of the present disclosure. The component having the same reference symbol as in FIG. 8 represents the same component with the same function.

Referring to FIG. 13, in the fluid supplying apparatus of this embodiment, both of the inner tube 44 and the outer tube 46 have substantially hexagonal cross-sections, identical to that of the fourth embodiment, but the pattern and locations of the holes 48 and 49 formed in the inner tube 44 are different from that of the fourth embodiment. The inner tube 44 of this embodiment includes four inclined right and left inner side walls 41*a*, and an inner upper wall 41*b* and an inner lower wall 41*c* which connect the right and left inner side walls 41*a*. The first holes 48 and the second holes 49 for primary injection of a fluid are formed through portions where both ends of the inner lower wall 41*c* are connected to the inclined side walls 41*a*.

Figure 14:
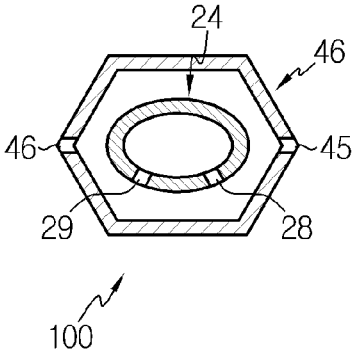
FIG. 14 is a sectional view showing a fluid supplying apparatus according to a tenth embodiment of the present disclosure.

FIG. 14 is a sectional view showing a fluid supplying apparatus according to a tenth embodiment of the present disclosure. The component having the same reference symbol as in FIGS. 6 and 11 represents the same component with the same function.

Referring to FIG. 14, in the fluid supplying apparatus 100 of this embodiment, the inner tube 24 has an oval cross-section, and the outer tube 46 has a hexagonal cross-section. The inner tube 24 of this embodiment has two rows of first holes 28 and second holes 29 which are formed through the lower surface of the oval cross-section to be arranged in parallel with each other for primary injection of a fluid.

Figure 15:
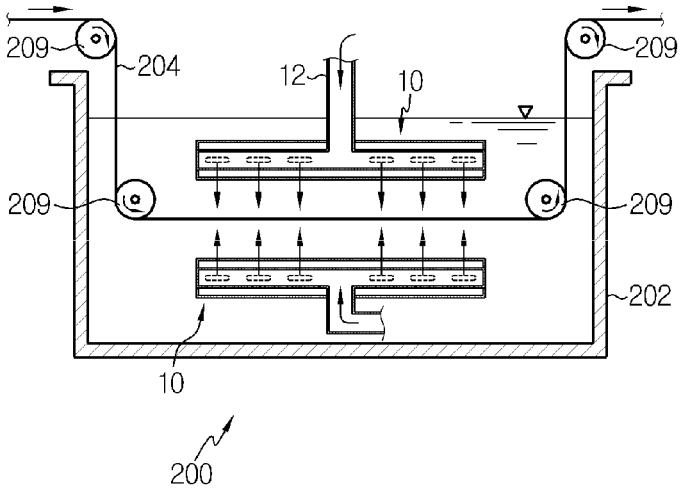
FIG. 15 is a schematic view showing a thin film cleaning system according to a preferred embodiment of the present disclosure.

FIG. 15 is a schematic view showing a thin film cleaning system according to a preferred embodiment of the present disclosure. The component having the same reference symbol as in FIGS. 3 to 5 represents the same component with the same function.

Referring to FIG. 15, the thin film cleaning system 200 of this embodiment includes the fluid supplying apparatus 10. The fluid supplying apparatus 10 is disposed in a cleaning bath 202 to be immersed in a cleaning fluid 203 stored in the cleaning bath 202 in order to remove impurities present on the surface (the upper and lower surfaces) of a thin film 204 successively moving in a submerged state in the cleaning fluid 203. The fluid supplying apparatus 10 may inject the cleaning fluid 203 supplied from a drain (not shown) of the cleaning bath 22 by a pump (not shown).

Meanwhile, any person having ordinary skill in the art would understand that the fluid supplying apparatus 10 may be substituted with any one of the fluid supplying apparatuses 20 to 100 according to other embodiments as described above. In addition, the thin film cleaning system 200 according to this embodiment is illustrated in a way that a pair of fluid supplying apparatuses 10 is installed above and below the moving thin film 204. However, it is also possible that the fluid supplying apparatus 10 is installed only above or below the thin film 204.

The double-tube type fluid supplying apparatus 10 installed in the cleaning bath 202 is supplied with the cleaning fluid 203 from the outside through the supply unit 12, and includes the inner tube 14 and the outer tube 16 vertically diverged from the supply unit 12 to uniformly inject the cleaning fluid 203 at a predetermined pressure toward the thin film 204. The inner tube 14 and the outer tube 16 have hollow structures. A plurality of holes 13 are formed in the upper surface of the inner tube 14 in a length direction. The first slots 15 and the second slots 17 are formed through both sides of the outer tube 16. The thin film 204 in the cleaning bath 202 is wound around several rollers 209 and is moved at a predetermined speed. The cleaning fluid injected from the slots 15 and 17 is mixed with the cleaning fluid 203 stagnating in the cleaning bath 202 and removes impurities present at the surface of the thin film 204 by the predetermined pressure applied to the surface of the thin film 204. In other words, in order to remove impurities adhered to the thin film 204, the thin film cleaning system 200 according to the preferred embodiment of the present disclosure adopts a double tube structure as the apparatus for injecting the cleaning fluid 203, thereby improving the mechanism of injecting the cleaning fluid. Therefore, a flow rate pattern of the injected fluid is not disturbed by other external factors, and the fluid may be injected to the thin film 204 at a uniform pressure under the conditions necessary for the thin film 204.

EXPERIMENTAL EXAMPLE

Figure 16:
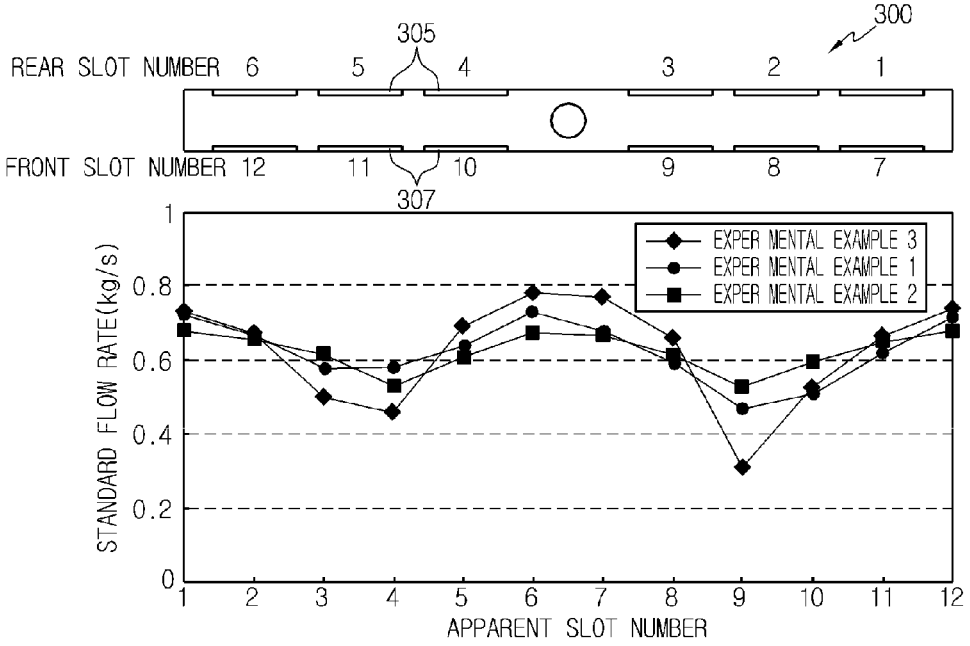
FIG. 16 is a graph showing test results of a flow rate of a fluid discharged through each slot when the fluid supplying apparatuses according to the first, second and seventh embodiments are respectively applied to the thin film cleaning system according to the preferred embodiment of the present disclosure.

FIG. 16 is a graph showing test results of a flow rate of a fluid discharged through each slot when the fluid supplying apparatuses according to the first, second and seventh embodiments are respectively applied to the thin film cleaning system according to the preferred embodiment of the present disclosure.

Referring to FIG. 16, the double-tube type fluid supplying apparatus used in this experimental example has six slots (e.g., rear slots) successively formed in one side of the outer tube in a length direction and six slots (e.g., front slots) successively formed in the other side of the outer tube. Therefore, the Arabic numerals depicted near a double tube 300 at the upper portion of FIG. 16 represent slots numbers (1 to 6) formed in the rear side and slot numbers (7 to 12) formed in the front side, respectively. Therefore, the measurement value in the graph represents a flow rate of the fluid injected through each slot.

As understood from the graph of FIG. 16, the flow rates of the fluids discharged from the first slot 305 and the second slot 307 opposite to each other (for examples the first slot and the seventh slot; the third slot and the ninth slot; or the sixth slot and the twelfth slot) are similar to each other. It is because the fluid primarily injected from the inner tube to the corresponding outer tube is uniformly distributed and injected.

Meanwhile, the performances of the double-tube type fluid supplying apparatuses according to the embodiments of the present disclosure were compared with that of the single-tube type fluid supplying apparatus by experiments, as follows. Here, the fluid supplying apparatuses according to the experimental example and the comparative example were respectively applied to the thin film cleaning system to measure the difference in average pressures applied to the upper and lower portions of the thin film, the difference in minimum pressures, the difference in maximum pressures, and their standard deviation. The measurement results are shown in Tables 1 to 4.

Comparative Example

Table 1 shows experiment results of the comparative example where the single-tube type fluid supplying apparatus 1 shown in FIG. 1 is used. The fluid supplying apparatus 1 used in the comparative example is a single-tube type nozzle tube with a circular cross-section and a diameter of 130 mm and having the hole 8 with a diameter of 10 mm.

TABLE 1

| Analysis (î âP = $P_{up} - P_{down}$) | Difference in minimum pressures (Min î âP) | Difference in maximum pressure (Max î âP) | Standard deviation (std. dev.) |
|---|---|---|---|
| (Comparative Example) Difference in average pressures applied to the upper and lower sides of the thin film | 2.61 | 4.63 | 0.35 |

Experimental Example 1

Table 2 shows the case where the double-tube type fluid supplying apparatus 10 according to the first embodiment of the present disclosure is used. In the double tube used in the experimental example 1, the inner tube 14 and the outer tube 16 respectively have circular cross-sections. In other words, the inner tube 14 has a diameter of 100 mm, and each hole 13 has a diameter of 10 mm. In addition, the outer tube 16 has a diameter of 130 mm, and the slots 15 and 17 have a length of 240 mm.

TABLE 2

| Analysis (î âP = $P_{up} - P_{down}$) | Difference in minimum pressures (Min î âP) | Difference in maximum pressure (Max î âP) | Standard deviation (std. dev.) |
|---|---|---|---|
| (First Embodiment) Difference in average pressures applied to the upper and lower sides of the thin film | 0.74 | 1.11 | 0.08 |

Experimental Example 2

Table 3 shows the case where the double-tube type fluid supplying apparatus 20 according to the second embodiment of the present disclosure is used. In the double tube used in the experimental example 2, the inner tube 24 and the outer tube 26 respectively have oval cross-sections. In other words, the inner tube 24 has a width of 200 mm and a height of 100 mm, and the holes 23 formed in the inner tube 24 have a diameter of 10 mm. In addition, the outer tube 26 has a width of 230 mm and a height of 130 mm, and the slots 25 and 27 of the outer tube 26 have a length of 240 mm.

TABLE 3

| Analysis ($^{i}$ âP = $P_{up}$ − $P_{down}$) | Difference in minimum pressures (Min$^{i}$ âP) | Difference in maximum pressure (Max$^{i}$ âP) | Standard deviation (std. dev.) |
|---|---|---|---|
| (Second Embodiment) Difference in average pressures applied to the upper and lower sides of the thin film | 0.46 | 0.83 | 0.09 |

Experimental Example 3

Table 4 shows the case where the double-tube type fluid supplying apparatus 70 according to the seventh embodiment of the present disclosure is used. In the double tube used in the experimental example 3, the inner tube 14 and the outer tube 16 respectively have circular cross-sections. In other words, the inner tube 14 has a diameter of 100 mm, and the holes 18 and 19 have a diameter of 10 mm. The holes 18 and 19 are configured in pair and formed in the lower surface of the inner tube 14 in a length direction. In addition, the outer tube 16 has a diameter of 130 mm, and the slots 15 and 17 have a length of 240 mm.

TABLE 4

| Analysis ($^{i}$ âP = $P_{up}$ − $P_{down}$) | Difference in minimum pressures (Min$^{i}$ âP) | Difference in maximum pressure (Max$^{i}$ âP) | Standard deviation (std. dev.) |
|---|---|---|---|
| (Seventh Embodment) Difference in average pressures applied to the upper and lower sides of the thin film | 1.23 | 2.31 | 0.08 |

Figure 17:
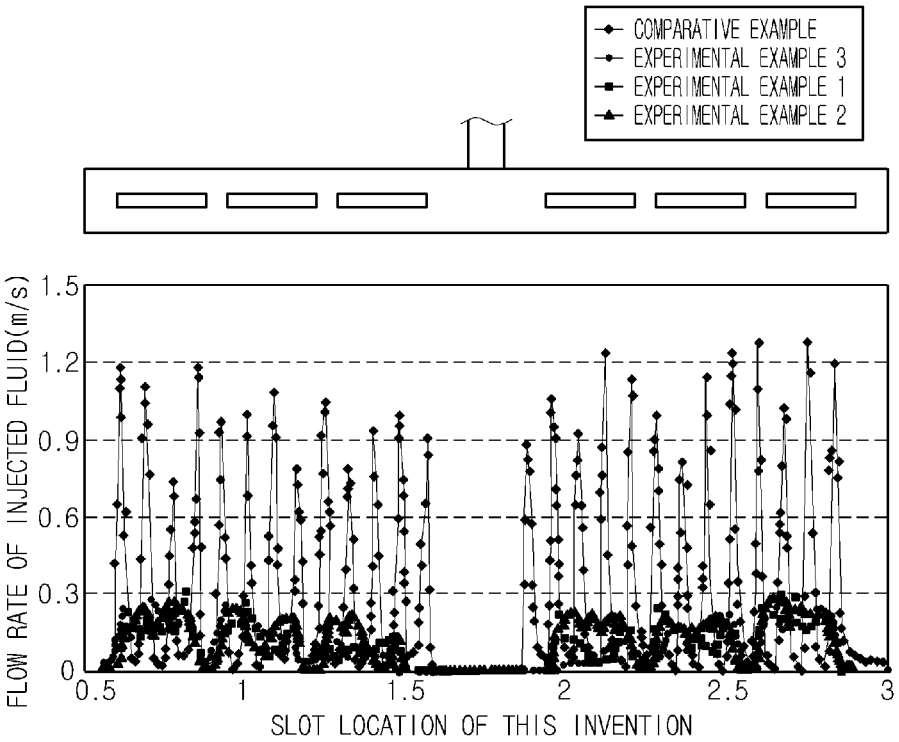
FIG. 17 is a graph showing a flow rate of a fluid corresponding to each slot of a double tube of the thin film cleaning system of FIG. 15.

FIG. 17 is a graph showing a flow rate of a fluid corresponding to each slot of the double tube of the thin film cleaning system of FIG. 15.

As in Tables 1 to 4 and FIG. 17, it could be found that all of the difference in minimum pressures, the difference in maximum pressures, and the standard deviation of the experimental examples 1 to 3 are decreased in comparison to those of the comparative example. It is because the deviation of flux and flow rate of the fluid injected by the double-tube type fluid supplying apparatuses according to the embodiments of the present disclosure are decreased in comparison to those of the single-tube type fluid supplying apparatus. Therefore, the difference in pressures applied to the surface (the upper and/or lower surfaces) of the thin film is relatively decreased, which may solve the conventional problem such as breakage of the thin film caused by a complicated flow pattern.

Meanwhile, when comparing the values of Tables 2 to 4, the experimental example 2 shows the most excellent effects, followed by the experimental example 3 and the experimental example 1. The fluid supplying apparatus 20 of the experimental example 2 has the same structure as that of the experimental example 1, except that the outer tube 26 and the inner tube 24 have oval cross-sections. In other words, it could be understood that the deviation of flux and flow rate is decreased when the fluid discharged from the holes 23 of the inner tube 24 of the experimental example 2 moves a relatively longer distance and is injected through the slots 25 and 27 of the outer tube 26. However, even though the fluid supplying apparatuses 10 and 70 of the experimental examples 1 and 3 where the fluid is injected after moving a shorter distance than the case of the experimental example 2 are used, the deviation of pressures applied to the thin film 204 is greatly decreased in comparison to the single-tube type nozzle tube 1. Therefore, the problems occurring during a thin film cleaning process, for example bending and folding of the thin film and resultant breakage of the thin film in a following process, may be solved.

The apparatus, system and method of the present disclosure stated in all embodiments as above include, for example, a thin film or a roll-type sheet with a thickness of several micrometers or several ten micrometers, a floor film or functional film, an industrial film, and an optical film, but it could be understood by those having ordinary skill in the art that the present disclosure may be utilized in production or cleaning processes for films with various shapes, without limited thereto.

The above description and accompanying drawings illustrate preferred embodiments of the present invention, and it should be understood that various additions, modifications, combinations and/or substitutes can be made without departing from the spirit and scope of the invention, as defined in the appended claims. In particular, it would be understood by those of ordinary skill in the art that the present invention may be implemented with different specific shapes, structures, arrangements, or ratios by using other elements, materials, and components within the scope of the invention. It would also be understood by those of ordinary skill in the art that the present invention can be used with many modifications of structures, arrangements, ratios, materials, and components to be particularly suitable for specific environments or operation conditions within the principle of the invention. Also, the features described in the specification can be used solely or in combination with other features. For example, any features described in relation with one embodiment may be used together with and/or as a substitute for other features described in another embodiment. Thus, the disclosed embodiments should be construed not to limit the invention but to illustrate the invention in all aspects, and the scope of the invention is defined in the appended claims and not limited by the detailed description.

Any person having ordinary skill in the art would understand that various changes and modifications can be made to the invention within the scope of the invention. Some of these changes and modifications have already been discussed above, and other changes will be apparent to those of ordinary skill in the art.

Reference Symbols

| | |
|---|---|
| 10, 20, 30, 40, 50, 60, 70, 80, 90, 100: fluid supply apparatus | |
| 12: supply unit | 13, 23, 33, 43: hole |
| 14, 24, 34, 44: inner tube | 15: first side slot |
| 16, 26, 36, 46: outer tube | 17: second side slot |
| 31a: inner side wall | 31b: inner upper wall |

-continued

| Reference Symbols | |
|---|---|
| 31c: inner lower wall | 32a: outer side wall |
| 32b: outer upper wall | 32c: outer lower wall |
| 202: cleaning bath | 203: cleaning liquid |
| 204: thin film | |

What is claimed is:

1. A thin film cleaning system, comprising:

a cleaning bath in which a fluid is stored so that a thin film is capable of moving while being immersed therein;

rollers on which the thin film can move; and a fluid supplying apparatus comprising:

an inner tube having a plurality of holes formed through an upper surface thereof for distributing a cleaning fluid supplied from a supply unit; and an outer tube arranged to surround the inner tube and having a plurality of slots for ejecting the cleaning fluid distributed therein from the holes to the outside, wherein both ends of the inner tube and the outer tube are closed, and the inner tube and the outer tube are coaxially arranged, wherein the slots include first side slots in one side of the outer tube in a length direction of the outer tube, and second side slots symmetrically arranged in the other side of the outer tube to be symmetrical to the first side slots based on a center of the outer tube, thereby the first and second slots symmetrically ejecting the cleaning fluid in opposite directions, wherein an ejecting direction of the cleaning fluid is perpendicular to a supplying direction of the cleaning fluid through the supplying unit, and wherein the fluid supplying apparatus is installed in the cleaning bath to be immersed in the fluid and eject a cleaning fluid toward a wall of the cleaning bath.

2. A thin film cleaning method, comprising moving a thin film in a state of being immersed in the fluid through the thin film cleaning system of claim 1.

3. The thin film cleaning method according to claim 2, wherein the fluid supplying apparatus of the thin film cleaning system is arranged such that a length direction of the outer tube is substantially in parallel to a direction in which the thin film is moving.

4. The thin film cleaning method according to claim 2, wherein the fluid is ejected laterally from opposite sides along a length direction of the outer tube of the fluid supplying apparatus of the thin film cleaning system.

5. The thin film cleaning method according to claim 2, wherein the inner tube and the outer tube of the fluid supplying apparatus of the thin film cleaning system have cross-sections with any one shape selected from the group consisting of circle, oval, rectangle and hexagon, or their combinations.

* * * * *